US009035207B2

(12) United States Patent
Huang et al.

(10) Patent No.: US 9,035,207 B2
(45) Date of Patent: May 19, 2015

(54) BUTTON DEVICE AND ELECTRONIC EQUIPMENT USING THE SAME

(71) Applicant: GEMTEK TECHNOLOGY CO., LTD., Hsinchu (TW)

(72) Inventors: Wei Chia Huang, Hsinchu (TW); Chih Jung Kao, Hsinchu (TW); Hu Chi Chang, Hsinchu (TW)

(73) Assignee: GEMTEK TECHNOLOGY CO., LTD., Hsinchu (TW)

( * ) Notice: Subject to any disclaimer, the term of this patent is extended or adjusted under 35 U.S.C. 154(b) by 92 days.

(21) Appl. No.: 13/893,800

(22) Filed: May 14, 2013

(65) Prior Publication Data

US 2014/0138222 A1 May 22, 2014

(30) Foreign Application Priority Data

Nov. 22, 2012 (TW) ..... 101143599 A

(51) Int. Cl.
*H01H 9/00* (2006.01)
*H01H 9/18* (2006.01)

(52) U.S. Cl.
CPC ..... *H01H 9/18* (2013.01)

(58) Field of Classification Search
USPC ..... 200/308–314, 17 R, 317, 341, 329
See application file for complete search history.

(56) References Cited

U.S. PATENT DOCUMENTS

| | | | | |
|---|---|---|---|---|
| 5,280,145 | A * | 1/1994 | Mosier et al. | 200/313 |
| 8,354,605 | B2 * | 1/2013 | Nogami | 200/302.1 |
| 2012/0234658 | A1 * | 9/2012 | Schnak et al. | 200/313 |

FOREIGN PATENT DOCUMENTS

| | | |
|---|---|---|
| TW | 201135783 | 10/2011 |

* cited by examiner

*Primary Examiner* — Edwin A. Leon
(74) *Attorney, Agent, or Firm* — Hamre, Schumann, Mueller & Larson, P.C.

(57) ABSTRACT

A button device has a circuit board, a tact switch having a pressed surface, a light source, and a resilient button capable of sliding relative to the circuit board. The resilient button includes a pressed portion having a projection surface and a light guide column connected to the pressed portion and directing light toward the projection surface. The light guide column includes a light receiving surface facing the light source with a certain distance apart and a touchable portion apart from the pressed surface with a certain distance used for touching the tact switch.

9 Claims, 7 Drawing Sheets

BUTTON DEVICE AND ELECTRONIC EQUIPMENT USING THE SAME

CROSS-REFERENCE TO RELATED APPLICATION

This application claims priority from Taiwan Patent Application No. 101143599 filed on Nov. 22, 2012, which is hereby incorporated herein by reference in its entirety.

BACKGROUND OF THE INVENTION

1. Field of the Invention

The present invention relates to a button device of an electronic apparatus, and more particularly to an integrated structure of a button and a light guide column which enables light to be uniformly refracted towards a projection surface of the button.

2. Description of Related Art

A traditional electronic apparatus with luminous buttons commonly spaces a light source from a tact switch with a certain distance, and disposes a transparent button on the tact switch for receiving the rays emitted from the light source. FIGS. 1 and 2 show the schematic diagrams of prior arts. Referring to FIGS. 1-2, an electronic apparatus comprises a motherboard 3. A flexible cable 7 is used to connect a daughter board 1 with a connection slot 6 of the motherboard 3, wherein the daughter board 1 comprises a light source 4, a tact switch 2 and a transparent button 5. As shown in FIG. 2, the light source 4 is upwards disposed on the tact switch 2 with an apart distance so that the brightness of the upper side of the transparent button 5 is greater than that of the under side of it. Therefore, the brightness is uneven on the whole transparent surface of the button 5. Referring to FIGS. 1-2, if the motherboard is aligned with the front cover of the case on which the button 5 is mounted at an angle of 90 degrees, the daughter board 1 is further required for such an alignment. Moreover, an additional flexible cable 7 is used to connect the daughter board 1 with the connection slot 6 of motherboard. The disadvantage of the electronic apparatus is that the cost is high, its weight and width is increased, and the assembly of its parts is more difficult.

SUMMARY OF THE INVENTION

The aspect of the application is to provide a button device capable of improving the uniformity of the brightness of its whole transparent surface and simplifying the structure of circuit boards.

According to the above aspect, the present invention provides an integrated structure of a button and a light guide column which enables rays from a light source to be uniformly and optimally directed towards a projection surface of the button through the total reflection design in the light guide column with light guide surfaces. The button device comprises: a circuit board; a tact switch disposed on the circuit board, wherein the tact switch has a pressed surface; a light source disposed on the circuit board; and a resilient button capable of sliding relative to the circuit board. The resilient button includes a pressed portion having a projection surface and a light guide column connected to the pressed portion and directing light rays toward the projection surface. The light guide column includes a light receiving surface facing the light source with a certain distance apart and a touchable portion apart from the pressed surface with a certain distance used for touching the tact switch.

In one embodiment, the resilient button is disposed on a case.

In one embodiment, the pressed portion is integrated with the light guide column monolithically.

In one embodiment, the material of the resilient button is at least one of polycarbonate (PC), polymethacrylate (PMMA), polystyrene (PS), and polyethylene terephthalate (PET).

In one embodiment, the light guide column comprises: a top surface parallel to the light receiving surface, a first reflecting surface disposed at an angle $\theta 1$ with respect to the light receiving surface, a second reflecting surface disposed at an angle $\theta 2$ with respect to the light receiving surface, and a third reflecting surface disposed at an angle $\theta 3$ with respect to the light receiving surface.

In one embodiment, the included angles $\theta 1$, $\theta 2$ and $\theta 3$ of the light guide column respectively satisfy $\theta 1 \leq 90°$, $90° \leq \theta 2 < 180°$ and $90° \leq \theta 3 < 180°$.

In one embodiment, the included angles $\theta 1$, $\theta 2$ and $\theta 3$ of the light guide column respectively satisfy $40° \leq \theta 1 \leq 70°$, $130° \leq \theta 2 < 150°$ and $130° \leq \theta 3 < 150°$ as the resilient button is made of polycarbonate.

In one embodiment, the included angles $\theta 1$, $\theta 2$ and $\theta 3$ of the light guide column respectively satisfy $\theta 1 = 60°$, $\theta 2 = 135°$ and $\theta 3 = 135°$ as the resilient button is made of polycarbonate.

The invention further provides an electronic apparatus, comprising a button device as described in any one of above embodiments.

DETAILED DESCRIPTION OF THE INVENTION

Figure 1:
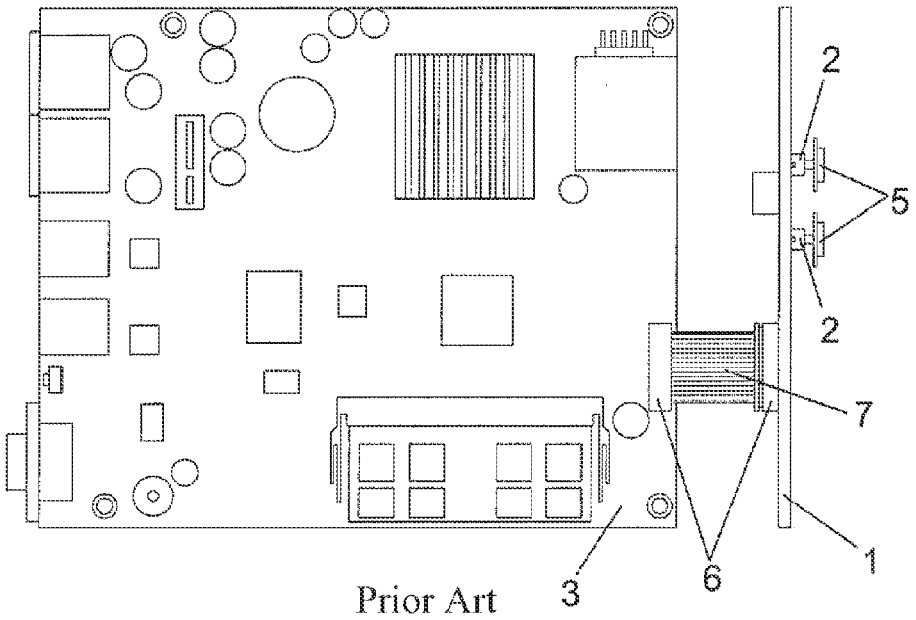
Prior Art Fig. 1
FIG. 1 is a top view of a prior art.
Figure 2:
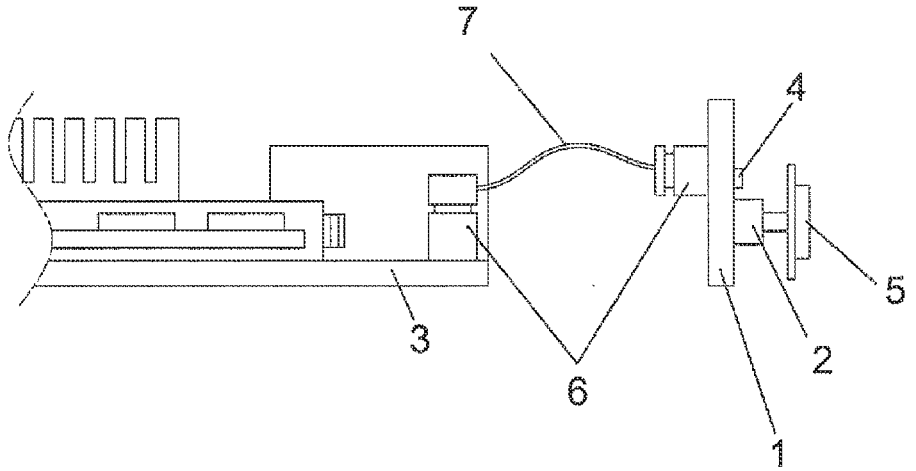
Prior Art Fig. 2
FIG. 2 is a side view of a prior art.
Figure 3:
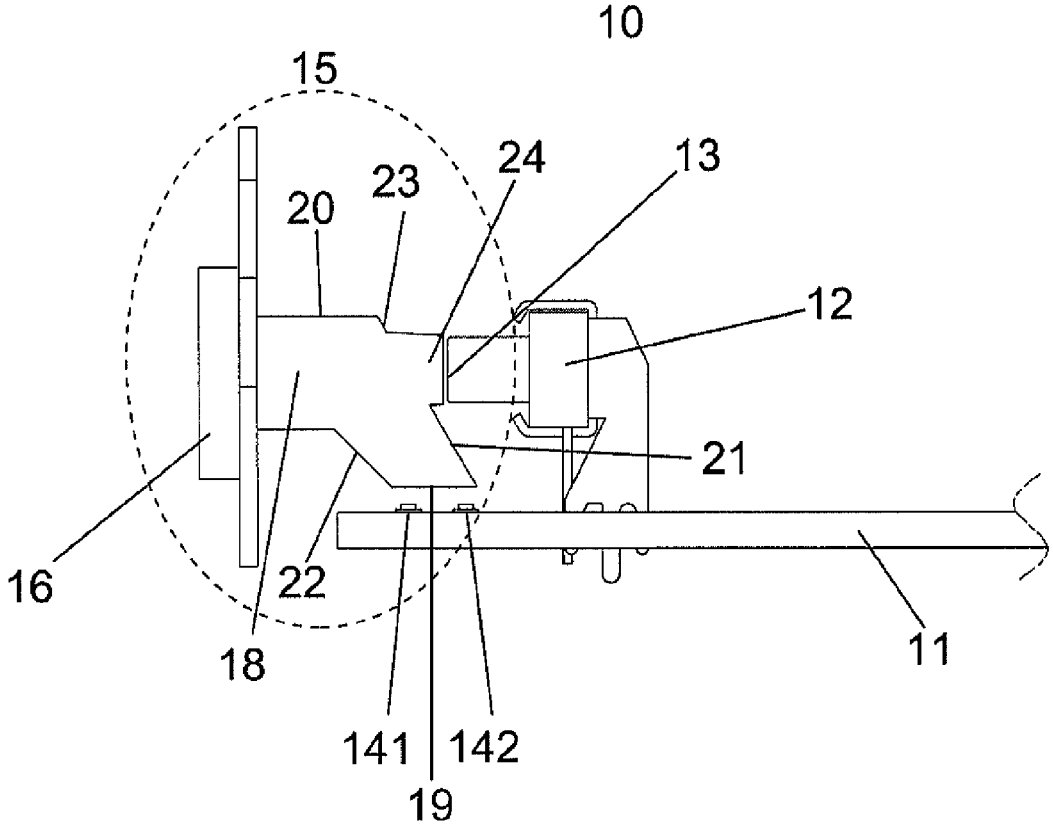
FIG. 3 is a side view of a button device of the present invention.
Figure 4:
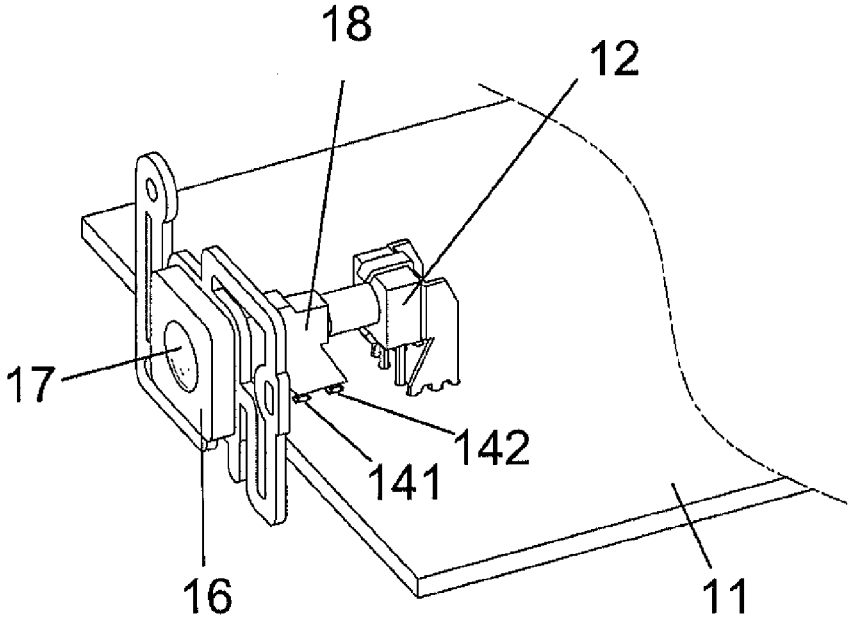
FIGS. 4-5 are perspective drawings of the button device of FIG. 3
Figure 5:
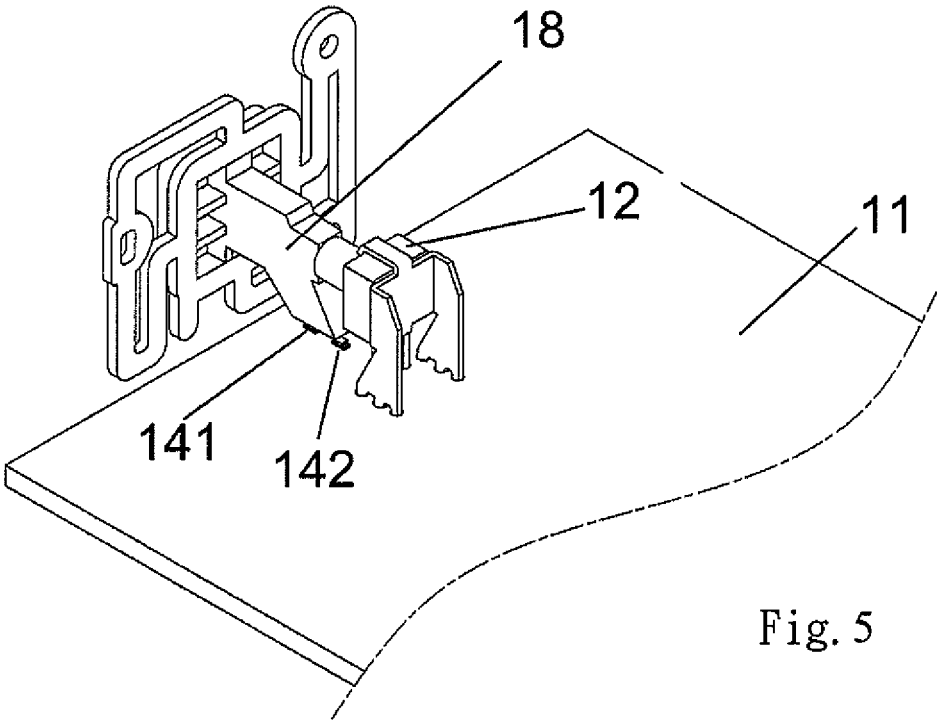

FIGS. 3, 4 and 5 respectively show a side view and a perspective view according to the present invention. As shown in FIGS. 3, 4 and 5, a button device 10 comprises: a circuit board 11; a tact switch 12 disposed on the circuit board 11, wherein the tact switch 12 has a pressed surface 13; light sources 141, 142 disposed on the circuit board 11; and a resilient button 15 capable of sliding relative to the circuit board 11.

The resilient button 15 includes a pressed portion 16 having a translucent or transparent projection surface 17 and a light guide column 18 connected to the pressed portion 16 and directing light rays of light sources 141, 142 toward the projection surface 17, wherein the pressed portion 16 is integrated with the light guide column 18 monolithically. The pressed portion 16 also can be attached to light guide column 18. As shown in FIG. 3, the light guide column 18 includes a top surface 20 on its top, a first reflecting surface 21, a second reflecting surface 22, a third reflecting surface 23, a light receiving (or incident) surface 19 facing the light sources 141 and 142 with a certain distance apart and a touchable portion 24 apart from the pressed surface 13 with a certain distance used for touching the tact switch 12.

Figure 6:
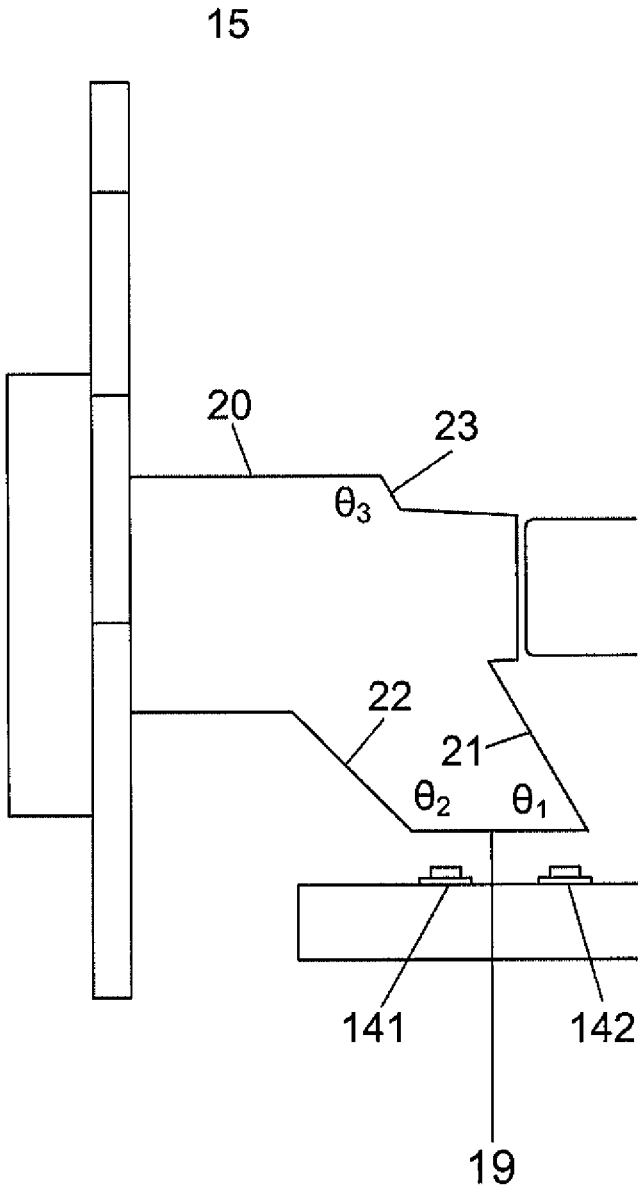
FIG. 6 is a partially enlarged drawing of the button device of FIG. 3.

Referring to FIG. 6, it shows the partially enlarged drawing of FIG. 3. As shown in FIG. 6, the first reflecting surface 21 is disposed at an angle θ1 with respect to the light receiving surface 19, the second reflecting surface 22 is disposed at an angle θ2 with respect to the light receiving surface 19, and the third reflecting surface 23 is disposed at an angle θ3 with respect to the light receiving surface, wherein the angles satisfy:

$$\theta 1 \leq 90°;$$

$$90° \leq \theta 2 < 180°; \text{ and}$$

$$90° \leq \theta 3 < 180°.$$

The light guide column 18 has a refractive index $n_1$. The invention optimizes the transmittance of the rays from the light guide column 18 by total internal reflection of the each reflecting surfaces. The critical angle θc is given by Snell's law:

$$n_1 \sin\theta_c = n_a \times \sin 90° = 1$$

$$\sin\theta_c = \frac{1}{n_1}$$

$$\theta_c = \sin^{-1}\frac{1}{n_1}$$

where refractive index of air $n_a$=1.

In the first embodiment of the present invention, Snell's Law shows that the critical angle $\theta_c$ is about 39.27° as light guide column 18 is made of polycarbonate, wherein the refractive index $n_1$ about 1.58. In this regards, the critical angle $\theta_c$ is given in the following:

$$\theta_c = \sin^{-1}\frac{1}{1.58} = 39.27°$$

Referring to FIG. 6, the light sources 141 and 142 are respectively disposed near the pressed portion 16 and the tact switch 12. The rays incident upon the light guide column 18 are refracted at the light receiving surface 19 and reflected from the reflecting surfaces, and then incident upon the projection surface 17 (not shown). The light sources 141 and 142 are composed of LED, wherein the angles satisfy:

$$40° \leq \theta 1 \leq 70°,$$

$$130° \leq \theta 2 < 150°, \text{ and}$$

$$130° \leq \theta 3 < 150°.$$

A part of reflected rays is reflected from the first reflecting surface 21 to the third reflecting surface 23, and then is incident upon the projection surface 17 (not shown) from the third reflecting surface 23 so as to maintain the uniform brightness of the upper side and lower side the projection surface 17.

In another embodiment, the angles θ1, 74 2 and θ3 are about θ1=60°, θ2=135° and θ3=135°. It is therefore to be understood that the numerical values do not limit the present invention. The numerical values may vary with the geometric shape and the material of the light guide column 18.

In other embodiments, the pressed portion 16 and the light guide column 18 are made of transparent (or translucent) material such as polycarbonate, polymethacrylate, polystyrene, and polyethylene terephthalate etc.

Figure 7:
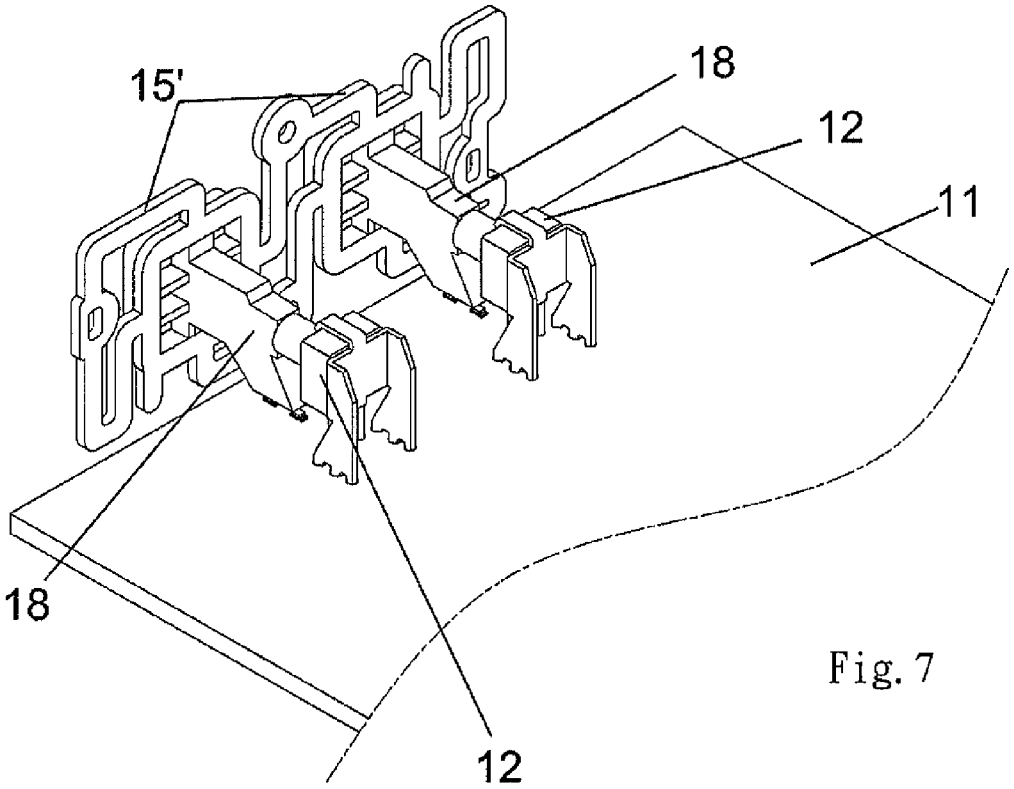
FIG. 7 is a perspective drawing of a button device according to another embodiment of the present invention.
Figure 8:
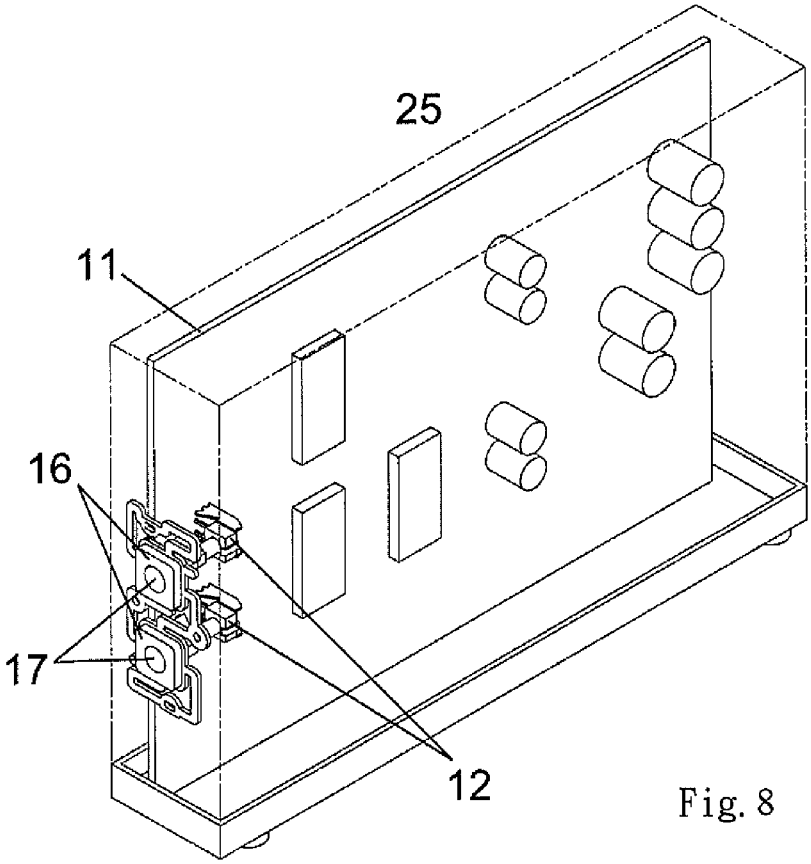
FIG. 8 is a schematic drawing of an electronic apparatus including the button device of FIG. 7.

In another embodiment of FIG. 7, a resilient button 15' includes two pressed portions (not shown) and two light guide column 18, wherein the pressed portions are integrated into one. FIG. 8 shows an electronic apparatus 25 comprising the button device of FIG. 7. Even though the mother board and the front cover of the case on which the button device is are arranged at an right angle with respect to each other, the present embodiment still can improve the uniform brightness of the projection surface 17.

Figure 9:
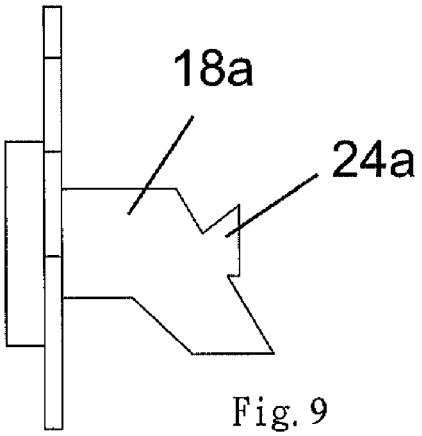
FIGS. 9-14 are perspective drawings of the button device according to the other embodiments of the present invention.
Figure 10:
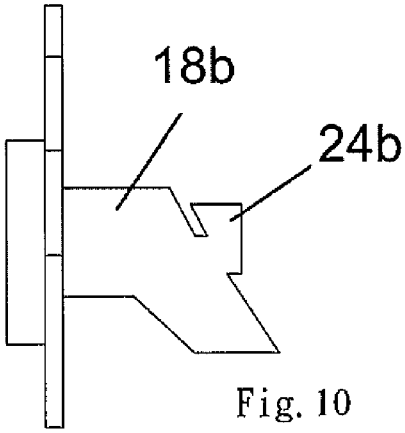
Figure 11:
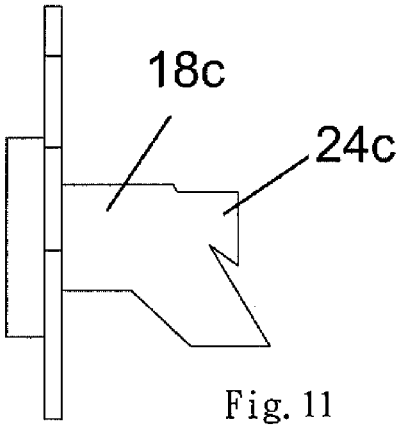
Figure 12:
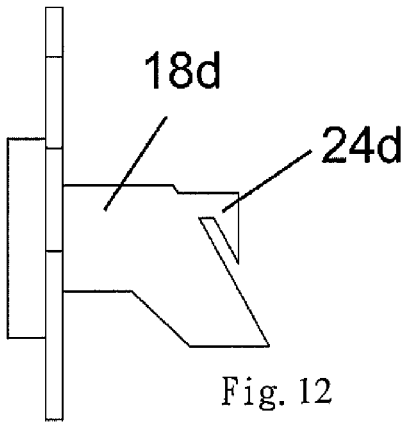
Figure 13:
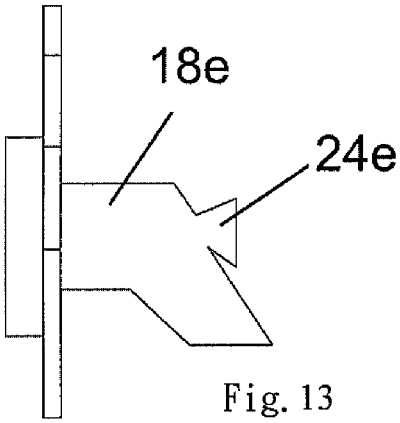
Figure 14:
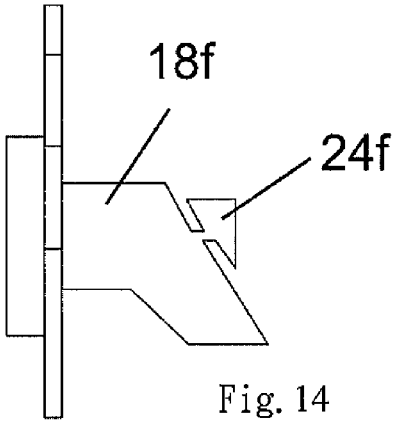

In other embodiments of FIGS. 9-14, the area of the touchable portions 24*a*-24*f* contacting the pressed surface 13 is still kept the same, and the light guide columns 18*a*-18*f* are substantially similar to above embodiments. The differences between the embodiments are in the shapes of the touchable portions 24*a*-24*f*, and the areas of the first reflecting surface 21 and the third reflecting surface 23. As shown in FIGS. 9-10, the area of the third reflecting surface 23 is greater than that of the above embodiment. As shown in FIGS. 11-12, the area of the first reflecting surface 21 is greater than that of the above embodiment. As shown in FIGS. 13-14, the areas of the first reflecting surface 21 and third reflecting surface 23 are greater than those of the above embodiment. The projection surface that can flexibly adjust the brightness and its uniformity in accordance with the areas of the first reflecting surface 21 and the third reflecting surface 23.

The disclosure and discussion set forth herein is illustrative and not intended to limit the practice of the instant invention. While there have been described what are believed to be the preferred embodiments of the instant invention, those skilled in the art will recognize that other and further changes and modifications may be made thereto without departing from the spirit of the invention, and it is intended to claim all such changes and modifications that fall within the full scope of the invention.

What is claimed is:

1. A button device comprising:
- a circuit board,
- a tact switch disposed on the circuit board, wherein the tact switch has a pressed surface,
- a light source disposed on the circuit board; and
- a resilient button capable of sliding relative to the circuit board, the resilient button comprising:
  - a pressed portion having a projection surface, and
  - a light guide column contacting the pressed portion and directing light toward the projection surface, the light guide column comprising:
    - a light receiving surface facing the light source with a predetermined distance apart, and
    - a touchable portion apart from the pressed surface with a predetermined distance used for touching the tact switch.

2. The button device of claim 1, wherein the resilient button is disposed on a case.

3. The button device of claim 2, wherein the pressed portion is integrated with the light guide column monolithically.

4. The button device of claim 3, wherein the resilient button is made of at least one of polycarbonate, polymethacrylate, polystyrene, and polyethylene terephthalate.

5. The button device of claim 4, wherein the light guide column comprises:
- a top surface parallel to the light receiving surface,
- a first reflecting surface disposed at an angle θ1 with respect to the light receiving surface,
- a second reflecting surface disposed at an angle θ2 with respect to the light receiving surface, and a third reflecting surface disposed at an angle θ3 with respect to the light receiving surface.

6. The button device of claim 5, wherein the angles θ1, θ2 and θ3 satisfy θ1≤90°, 90°≤θ2<180° and 90°≤θ3<180°.

7. The button device of claim 5, wherein the angles θ1, θ2 and θ3 satisfy 40°≤θ1≤70°, 130°≤θ2<150° and 130°≤θ3<150° as the resilient button is made of polycarbonate.

8. The button device of claim 5, wherein the angles θ1, θ2 and θ3 satisfy θ1=60°, θ2=135° and θ3=135° as the resilient button is made of polycarbonate.

9. An electronic apparatus, comprising:

a button device as claimed in claim 1.

* * * * *